United States Patent [19]

Waiss

[11] 4,359,179

[45] Nov. 16, 1982

[54] APPARATUS FOR DETECTING A MALFUNCTION IN THE PAPER FEED SYSTEM OF A PRINTER

[75] Inventor: John R. Waiss, Northfield, Ill.

[73] Assignee: Teletype Corporation, Skokie, Ill.

[21] Appl. No.: 201,118

[22] Filed: Oct. 28, 1980

[51] Int. Cl.[3] ..... B65H 25/00; B65H 25/32; B65H 17/38

[52] U.S. Cl. ..... 226/25; 226/43; 226/74; 226/188

[58] Field of Search ..... 226/1, 6, 10, 11, 24, 226/25, 33, 37, 45, 52, 74, 75, 170, 171, 172, 168, 181, 186, 187, 190, 193, 88

[56] References Cited

U.S. PATENT DOCUMENTS

| | | | |
|---|---|---|---|
| 3,132,785 | 5/1964 | Kunz | 226/186 X |
| 3,822,641 | 7/1974 | Babler | 101/93 C |
| 3,825,162 | 7/1974 | Hubbard | 226/74 |
| 3,941,288 | 3/1976 | Wanat | 226/74 |
| 3,958,735 | 5/1976 | Wanat | 226/1 |

*Primary Examiner*—Stanley N. Gilreath

*Attorney, Agent, or Firm*—W. K. Serp; J. C. Albrecht

[57] ABSTRACT

The drive shaft 30 of a printer 10 engages a tractor 16 which, in turn, moves a paper web 12 across a print mechanism 14. Located on the drive shaft 30 is a drive shaft advance cam 78 which is fixed to drive the shaft 30 and rotate therewith. Additionally, located upon the drive shaft 30 for limited rotational movement with respect to the drive shaft advance cam 78 is a paper advance cam 90. The shape of the drive shaft cam 78 is similar to the shape of the paper advance cam 90. The paper advance cam 90 carries an O-ring 102 defining a high frictional surface for engaging the paper web 12. The door 50 of the tractor 16 carries a paper pressure roller 104 having a circumferential groove 106 positioned for cooperation with the O-ring 102. During normal paper web 12 drive, the cams 78, 90 are out of registration and rotate in unison. In response to a paper web jam condition, the paper drive cam 90 driven by the paper web 12 momentarily stops and the cam falls 78, 90 are forced into registration resulting in the actuation of a switch 60.

4 Claims, 7 Drawing Figures

APPARATUS FOR DETECTING A MALFUNCTION IN THE PAPER FEED SYSTEM OF A PRINTER

DESCRIPTION

1. Technical Field

This invention relates to apparatus for detecting malfunctions in the paper feed system of a printer.

2. Background Art

The rapid growth of data communications systems has greatly increased the demand for high speed alphanumeric printers which print data in readable form upon a paper web. Such printers are frequently operated on a continuous basis and require operator attendance only for replacement of an exhausted paper supply or clearance of a paper jam condition.

The paper stationary or forms used in such printers are generally supplied as a continuous sheet with transverse perforations which facilitate the removal of selected pages. Additionally, extending longitudinally adjacent the edges of the paper are a series of spaced sprocket holes which are engaged by drive tractors provided on the printer. The tractors drive the paper across the print mechanism.

Occasionally during the operation of such printers the paper will for one reason or another stop moving. This is known as a "paper jam". On such an occasion, paper movement is inhibited; however, the drive tractors continue to move and thus cause the paper perforations to be torn. If the print mechanism continues to function, it will produce "typeovers" which obliterate the previously typed information with subsequent print. Thus, it is advantageous for such printers to include apparatus for detecting "paper jam" conditions, for providing the attendant with a suitable indication, and for interrupting operation of the machine when such malfunction occurs. One such paper drive malfunction detecting apparatus is described in U.S. Pat. No. 3,958,735 entitled "Method and Apparatus for Detecting Paper Drive Malfunctioning In an Automatic Printer", issued to R. R. Wanat on May 25, 1976. A particular difficulty encountered with this device, when single-ply paper is used under high humidity conditions, is that the paper sprocket holes tend to elongate due to the high frictional drive coefficient between the paper jam sensing mechanism and the paper. When this prior device is used with multi-ply paper, reliability decreases due to an excessive reduction in the frictional drive coefficient between the various paper plys and between the paper and the jam sensing mechanism which is driven by the paper.

DISCLOSURE OF THE INVENTION

In accordance with this invention, the operative condition of a paper web transported along a predetermined path in a printer is sensed by a drive mechanism which engages the paper web. The drive mechanism imparts the desired movement to the paper web. A first cam is coupled to the drive mechanism and provides an indication of the desired movement of the paper web and a second cam is coupled to the paper web and provides an indication of the actual movement of the paper web. First means is included which is responsive to the first and second cams and provides a signal in response to the relative positions of the cams and thus provides an indication of the actual movement or lack of movement as compared to the desired movement of the paper web. The second cam includes an O-ring located about an outer surface thereof. The second cam is positioned so that the O-ring is in frictional driven engagement with the paper web. A pressure roller defining a circumferential groove is biased against the second cam and is positioned so that the groove is adjacent the O-ring thereby assuring that the paper web and the O-ring are in frictional engagement.

The illustrated apparatus provides an improved means for detecting the presence of a paper jam in a high speed sprocket printer.

THE DRAWINGS

DETAILED DESCRIPTION

Figure 1:
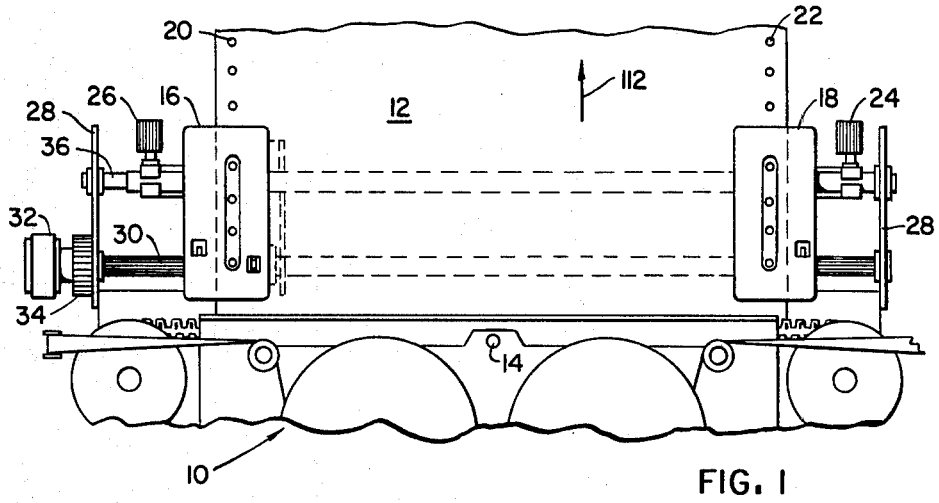
FIG. 1 is a front plan view of a portion of a printer including a paper drive mechanism.

A portion of a high speed printer 10 for driving a continuous paper web 12 across a print mechanism 14 is illustrated in FIG. 1. A suitable print mechanism for use with the illustrated apparatus is described in U.S. Pat. No. 3,822,641 entitled "Impactor Assembly For Printers" by Egon S. Babler issued July 9, 1974, having a common assignee with this application. The apparatus of FIG. 1 further includes a pair of drive tractors 16 and 18 which serve to drivingly engage sprocket holes 20 and 22 located along the longitudinal edges of the paper web 12 and thereby draw the paper web across the print mechanism 14. Suitable drive tractors are described in U.S. Pat. No. 3,825,162 entitled "Feed Mechanism issued to Leo J. Hubbard" on July 23, 1974. Additionally, the illustrated apparatus includes form width adjustment means 24 for varying the relative spacing of the tractors 16 and 18 so as to permit adaptation to various web widths. Type margin adjustment means 26 is also included for positioning both tractors 16 and 18 in unison and thus the paper web 12 carried by the tractors with respect to the print mechanism 14 so as to effect accurate placement of the type margin upon the paper web 12. The illustrated adjustment means 24 and 26 are more fully described in U.S. Pat. No. 3,941,288 issued Mar. 2, 1976 to R. R. Wanat, entitled "Apparatus For Positioning A Web" and having a common assignee with this application.

More particularly, the printer 10 includes a main frame 28 which supports an elongated splined drive shaft 30 the longitudinal axis of which is parallel to the plane of the paper web 12. The shaft 30 drivingly passes through the tractors 16 and 18 and is manually driven by a knurled web advance knob 32 secured to one end thereof adjacent the main support frame 28. Additionally, the splined drive shaft 30 is driven by a suitable motor (not shown) through gearing means 34. The drive tractors 16 and 18 slidably move along the drive shaft 30 and are also mounted upon a support rod 36. The axis of the rod 36 is parallel to the axis of the drive shaft 30. The ends of the support rod 36 are secured to the main support frame 28 with the axis of the rod 36 substantially parallel to the paper web 12. The rod 36, in conjunction with the splined drive shaft 30, provides a railed path upon which the tractors 16 and 18 ride.

Figure 2:
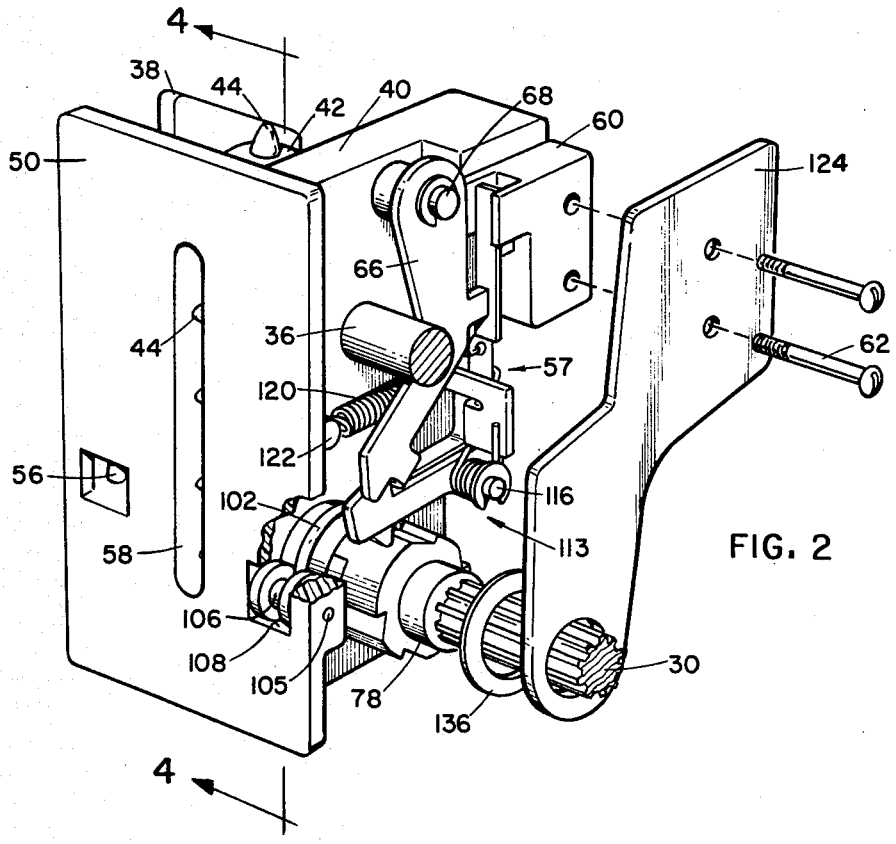
FIG. 2 is a perspective view of a tractor having a paper jam alarm included as a component of the printer of FIG. 1.
Figure 3:
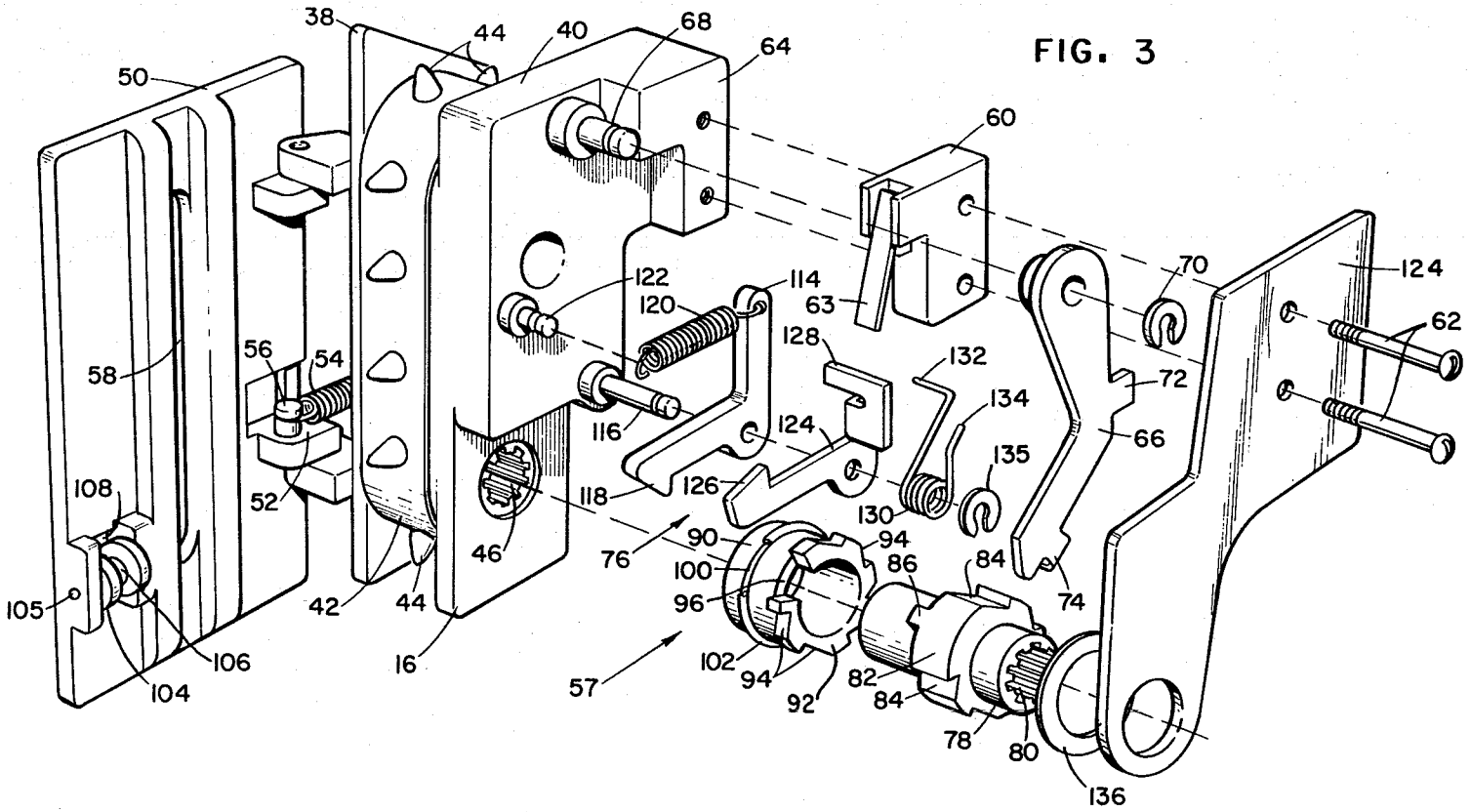
FIG. 3 is an exploded assembly view of the tractor and paper jam alarm illustrated in FIG. 2.

With reference to FIGS. 2 and 3, the tractor 16 includes a pair of parallel positioned end plates 38, 40 through which the drive shaft 30 and support rod 36 pass. Positioned between the end plate 38, 40 and aligned thereby is a continuous flexible belt 42 carrying a plurality of equally spaced web pull pins 44. The pins 44 are spaced to engage the holes 20 defined along the margins of the paper web 12. The splined drive shaft 30 passes through a drive spool 46 which engages the belt 42 so that, as the shaft 30 rotates, the paper web 12 engaged by the pins 44 is drawn across the print mechanism 14. Serving to hold the paper web 12 against the belt 42 and thus assure engagement by the pins 44, is a door 50 hinged to the support plate 38 and movable from a closed position to an open position. Maintaining the door 50 securely in its selected position is an over center toggle mechanism 52 including a coil spring 54 one end of which is secured to a post 56 affixed to the lower hinge of the door 50. The remaining end of the spring 54 is secured to the side plate 38 of the tractor 16. Additionally, the door 50 defines an elongated opening 58 through which the pins 44 project.

Figure 4:
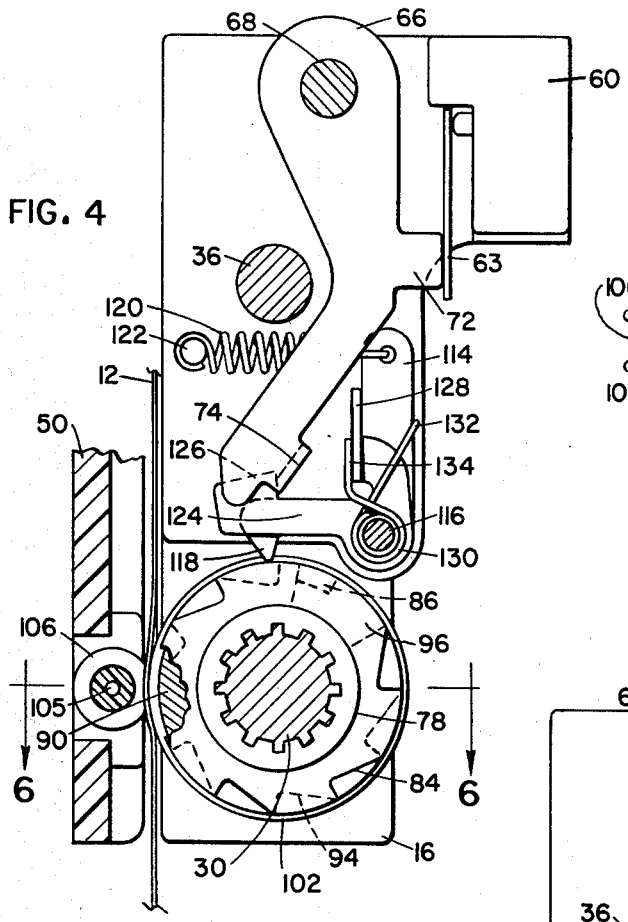
FIG. 4 is an enlarged sectional view taken along the line 4—4 of FIG. 2 illustrating a first operational mode of the paper jam alarm of FIG. 2.
Figure 5:
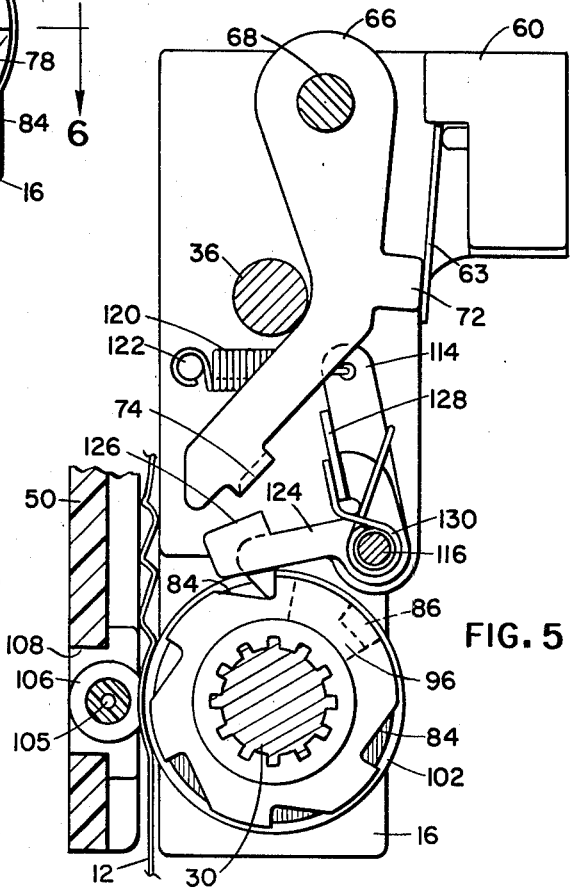
FIG. 5 is an enlarged sectional view also taken along the line 4—4 of FIG. 2 illustrating an alternate operational mode of the paper jam alarm of FIG. 2.

A paper jam mechanism 57 is mounted on the tractor 16 and includes a paper jam switch 60 secured by screws 62 to a raised mounting platform 64 formed with the tractor side plate 40. In response to a paper jam condition, a spring biased lever 63 of the switch 60 is released by a switch actuating arm 66 which is pivotably supported at one end by a switch actuating arm pivot rod 68. The rod 68 projects from the tractor side plate 40. The arm 66 is secured to the pivot rod by a split ring washer 70. The arm 66 includes a switch actuating tab 72 and a locking hook 74 which engages a cam follower assembly 76 to be further described. The paper jam mechanism 57 further includes a generally cylindrically shaped drive shaft advance cam 78 positioned on the drive shaft 30 for rotation therewith. The drive shaft advance cam 78 defines a cylindrical opening 80 having a fluted surface which engages the splines of the drive shaft 30. The drive shaft advance cam 78 includes a raised collar 82. The outer surface of the collar 82 defines a cam surface having a series of arcuately spaced recesses or falls 84 and an axially extending stop tab 86 which serves to limit relative rotational movement of a generally cylindrically shaped paper advance cam 90. The paper advance cam 90 slidably fits over one end of the drive shaft advance cam 78. The end of the paper advance cam 90 adjacent the drive shaft cam 78 has a collar 92 which defines a cam surface having a plurality of arcuately spaced recesses or falls 94 which are spaced and shaped to match the cam falls 84 defined by the drive shaft advance cam 78. The paper advance cam 90 has a notch 96 into which the drive shaft advance cam 78 limit tab 86 extends. The size of the notch 96 is such that it allows relative rotational movement of the recesses 84, 94 of the two cams 78, 90 into and out of alignment. Thus, when the paper advance cam 90 is rotated clockwise with respect to the drive shaft advance cam 78 (as viewed in FIGS. 4 and 5) until relative movement is stopped, the cam recesses 84 and 94 are fully out of alignment (FIG. 4). When the cam 90 is rotated counter-clockwise with respect to the drive shaft advance cam 78, the cam recesses 84 and 94 are in alignment (FIG. 5).

The paper advance cam 94 also defines an outwardly disposed, narrow circular, continuous notch 100 into which a resilient O-ring 102 is seated. The O-ring 102 is preferably constructed of polyurethane having a Durometer Shore A 65–75 characteristic. Selectively positioned adjacent the O-ring 102, carried by the paper advance cam 90, is a paper pressure roller 104 the surface of which defines a continous circumferentially disposed groove 106. The tractor door 50 defines a slot 108 into which the pressure roller is positioned and held in place by an axle pin 105. As previously mentioned, the door 50 is biased into position by means of the coil spring 54, thus forcing the roller 104, carried by the door 50, against the surface of the paper. Thus, the paper web 12 is held in frictional drive engagement with the O-ring 102 carried on the paper advance cam 90. As the paper web 12 moves through the printer 10 in the direction indicated by the arrow 112 of FIG. 1, the cam 90 rotates in a clockwise direction (as viewed in FIGS. 4 and 5). The linear velocity of the paper web 12 is greater than the tangential velocity of the O-ring 102 resulting in sliding contact between the paper and the O-ring. This feature assures that the paper cam 90, during normal operation, will be held in its most clockwise position with respect to the drive shaft advance cam 78.

The paper jam mechanism 57 also includes the cam follower assembly 76 having a crank shaped follower arm 114 pivotably supported on a pivot rod 116 projecting from the tractor side plate 40. One end of the follower arm 114 defines a follower tip 118 which simultaneously rides on the paper advance cam 90 and the drive shaft cam 78. The remaining end of the follower arm 114 is affixed to a coil spring 120 and the opposite end of the follower arm is secured to a spring support post 122 extending from the tractor 16 side plate 40. The spring 120 biases the follower arm 114 in a counterclockwise direction about the pivot rod 116 urging the follower tip 118 against the surface of the cams 78 and 90. The cam follower assembly 13 further includes a switch release lever 124 which pivots upon the pivot rod 116 and includes a switch actuating arm release tab 126, as well as an extension 128 which projects toward the follower 114 and rides along the upwardly oriented leg of the follower 114 to which the coil spring 120 is attached. A release coil spring 130 having two extending ends 132, 134 is placed on the rod 116. The end 132 of the release spring is hooked over the upper leg of the follower 114 and the end 134 rests against the extension 128 of the release lever 124. Thus, the spring 130 biases the extension 128 against the follower 114. The switch release lever 124 is free to move counterclockwise with respect to the follower 114 against the bias of the spring 130, thus allowing engagement with the locking tab 74 of the switch actuating arm without rotational movement of the follower arm 114 about the rod 116. The cam follower assembly 76 is secured to the short rod 116 by a split ring washer 135. The paper pin mechanism 57 is held in position on the tractor 16 by a retaining plate 124 secured to the side walls 40 by the screws 62. A spring washer 136 is positioned over the end of the cam 78 and is held in place by the plate 124 and biases the cams 78 and 90 against each other and toward the plate 16.

For purpose of discussion, it is assumed that the paper web 12 is positioned as illustrated in FIG. 1 with the sprocket holes 20, 22 along the marginal edges of the paper web 12 engaging the respective tractors 16, 18. Closure of the tractor door 50 forces the pressure roller 104 against the paper web 12 and the paper web 12 in turn against the O-ring 102 of the paper advance cam 90. In response to rotation of the shaft 30 in a clockwise direction (FIGS. 4 and 5), the drive spool 46 drives the belt 42 carrying the pins 44 thereby drawing the paper web 12 across the print mechanism 14. Linear movement of the paper 12 produces clockwise rotational movement of the paper advance cam 90 and the drive shaft position cam 78 also rotates with the drive shaft 30. Under conditions of normal paper drive, the cams 78 and 90 are out of registration as illustrated in FIG. 4. It will be appreciated that throughout rotation of the cams 78 and 90, a rise on the surface of one of the cams is always presented to the follower tip 118.

The operation of the paper jam mechanism 57, in response to a paper jam condition, is illustrated in FIG. 5. In the event that the paper web 12 fails to smoothly feed past the print mechanism 14, the drive shaft 30 will, nevertheless, continue to rotate as will the drive shaft position cam 78. However, under such conditions, linear paper movement stops as does rotation of the paper advance cam 90. The shaft advance cam 78 continues to rotate until the stop tab 86 hits a wall of the notch 96 of the paper advance cam 90. Once the stop tab 86 is forced against the wall of the notch 96, the cams 78 and 90 rotate together in a clockwise direction with the drive shaft 30. The cams 78 and 90 thereafter rotate in registration, and upon alignment of the falls 84, 94 of both cams 78, 90 with the follower arm tip 118, the release lever 124 will release the locking hook 74 of the switch actuating arm 66. The switch actuating arm 66 moves in a counterclockwise direction under bias of the spring loaded switch lever 63 of the switch 60, thus releasing the switch 60 which provides an indication by suitable means of the presence of a paper jam condition. The operator opens the tractor doors 16 and 18 and clears the paper jam condition.

Prior to repositioning the paper web 12 to clear the jam condition, the operator manually rotates the paper advance cam 90 in a clockwise direction relative to the paper advance cam 78 until the tab 86 hits the opposite wall of the notch 96 at which time the falls 84, 74 of the cams 78, 90 are out of alignment. Once the cams 78, 90 are out of alignment, the switch actuating arm 66 is manually rotated counterclockwise about its pivot post 68 until the locking hook 74 engages the release tab 126 and the lever 63 of the switch 60 is depressed. Thereafter, the paper web 12 is repositioned in the tractor and printing is resumed.

Figure 6:
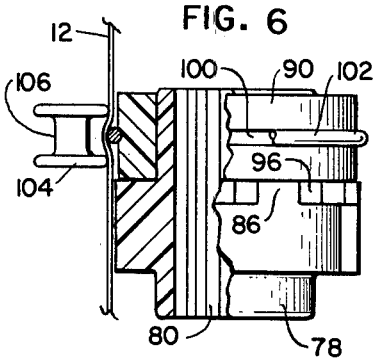
FIG. 6 is a fragmentary sectional view taken along the line 6—6 of FIG. 4 illustrating the operation of the paper jam alarm in combination with single-ply paper.

The O-ring 102 in combination with the grooved pressure roller 104 mounted upon the tractor door 50 provides improved operational characteristics. It should be noted that the circumferential groove 106 defined by the pressure roller 104 is larger than the size of the O-ring 102 and thus a considerable amount of clearance is provided around the O-ring 102 when the door 50 is closed. Thus, when the printer 10 is used with a single-ply paper web 12 as shown in FIG. 6, the paper web 12 tends to slightly deform about the O-ring reducing the frictional coupling between the O-ring and the paper web 12. This adaptation of the paper web 12 to the shape of the O-ring 102 greatly reduces the frictional driving force between the paper 12 and the paper advance cam 90 and thus reduces the force on the holes 20 along the side of the paper. This arrangement allows the paper web 12 to slip in relation to the paper advance cam 90. The reduced coupling between the paper web 12 and the O-ring 102 minimizes the possibility of sprocket hole 20 elongation along the margin of the paper web 12 which can result in print misregistration.

Figure 7:
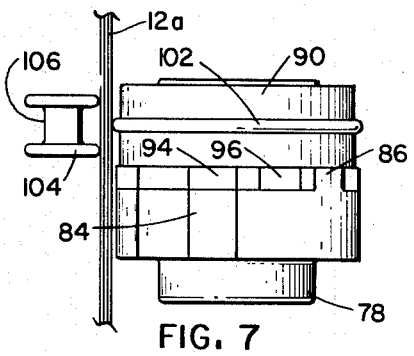
FIG. 7 is a fragmentary sectional view taken along the line 6—6 of FIG. 4 illustrating the operation of the paper jam alarm in combination with multi-ply paper.

In FIG. 7, the jam alarm assembly is shown in combination with multi-ply paper web **12*a*. The multi layers of paper web 12*a* in combination are considerably stiffer than the single-ply paper web 12 and thus resists deformation about the groove 106 of the pressure roller 104. This condition results in the concentration of the force of the pressure roller 104 under bias of the door 50 spring 54 on the paper 12*a* along a relatively small area of the surface of the O-ring 102. The concentration of the force of the pressure roller 104 assures that the paper advance cam 90 will drive the paper web 12*a*. Thus, the illustrated arrangement provides a paper jam mechanism 57** which adapts to single as well as multi-ply paper.

Although the invention has been particularly shown and described with reference to a preferred embodiment thereof, it will be understood that various changes in form and detail may be made without departing from the scope and spirit of the invention.

What is claimed is:

1. An apparatus for detecting a malfunction in the paper web (12) feed system of a printer wherein the paper web (12) is transported along a predetermined path by a drive mechanism (16, 30) engaging the paper web (12) and thereby imparting a desired movement to the paper web (12) comprising:

a first cam (78) coupled to said drive mechanism (16, 30) and providing an indication of the desired movement of the paper web (12);

a second cam (90) coupled to the paper web (12) and providing an indication of the actual movement of the paper web (12);

first means (114) responsive to said first and second cams (78, 90) for providing an indication in response to the relative positions of said first and second cams which indication is related to the actual movement as compared to the desired movement of the paper web (12);

said second cam (90) including a resilient O-ring (102) located about an outer surface thereof, said second cam (90) positioned so that said O-ring (102) is in frictional driven engagement with the paper web (12);

a pressure roller (104) having a circumferential groove (106);

means (54, 56) for biasing said pressure roller (104) against said second cam (90), said pressure roller (104) being positioned so that the groove (106) of said pressure roller (106) is adjacent said O-ring (102) thereby assuring that the paper web (12) and said O-ring (102) are in frictional driving engagement;

a follower (114) responsive to said first (78) and second (90) cams;

a switch (60);

a second means (66) responsive to the position of said follower for actuating said switch (60) in response to a predetermined relative position of said first and second cams (78, 90);

a pivotably supported switch actuating arm (66) positioned for selective actuation of said switch (60), said switch actuating arm being movable between a switch engaging position and a switch release position;

a switch actuating arm release lever (124):

third means (130) for urging said lever (124) into predetermined position relative to said follower (114) and said lever (124) having means (126) for selectively engaging said switch actuating arm; and said release lever (124) having a first position engaging said actuating arm (66) determined by a first relative position of said cams (78, 90) for holding said actuating arm (66) in said switch engaging position and a second position determined by a second relative position of said cams (78, 90) for releasing said actuating arm (66) for movement to said switch release position.

2. The apparatus of claim 1 wherein said release lever (124) is biased into position with respect to said follower (114) by a spring (130), said spring (130) allowing relative movement between said follower (114) and said release lever (124) in a first direction to permit engagement of said switch actuating arm (66) and said release lever (124) without movement of said follower (114).

3. The apparatus of claim 2 wherein said O-ring (102) exhibits a Shore A 65–75 characteristic.

4. The apparatus of claim 3 wherein said O-ring (102) is constructed of polyurethane.

* * * * *